US006721528B1

(12) United States Patent
Schreieder et al.

(10) Patent No.: US 6,721,528 B1
(45) Date of Patent: Apr. 13, 2004

(54) METHOD AND CONTROLLING MEANS FOR REGULATING THE POSITION OF A BAND-SHAPED IMAGE CARRIER IN AN ELECTROGRAPHIC APPARATUS

(75) Inventors: Josef Schreieder, Malgersdorf (DE); Stefan Scherdel, Markt Schwaben (DE); Franz Hintler, Aschau (DE); Heiner Reihl, Freising (DE); Otto Ferber, Germering (DE); Winfried Topp, München (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 10/049,194

(22) PCT Filed: Aug. 10, 2000

(86) PCT No.: PCT/EP00/07403

§ 371 (c)(1),
(2), (4) Date: May 13, 2002

(87) PCT Pub. No.: WO01/11432

PCT Pub. Date: Feb. 15, 2001

(30) Foreign Application Priority Data

Aug. 10, 1999 (DE) ..... 199 37 776

(51) Int. Cl.[7] ..... G03G 15/00

(52) U.S. Cl. ..... 399/302; 198/807; 399/165; 399/301

(58) Field of Search ..... 399/302, 308, 399/301, 162, 165, 38; 198/807

(56) References Cited

U.S. PATENT DOCUMENTS

| | | | | |
|---|---|---|---|---|
| 4,061,222 A | | 12/1977 | Rushing | 198/807 |
| 4,959,040 A | | 9/1990 | Gardner et al. | 474/103 |
| 5,096,044 A | | 3/1992 | Biebel | 198/502.4 |
| 5,225,877 A | | 7/1993 | Wong | 399/75 |
| 5,248,027 A | | 9/1993 | Kluger et al. | 198/502.4 |
| 5,515,139 A | | 5/1996 | Hou et al. | 399/38 |
| 5,903,805 A | | 5/1999 | Ueda et al. | 399/165 |
| 5,991,561 A | * | 11/1999 | Okamoto et al. | 399/302 X |
| 6,493,533 B1 | * | 12/2002 | Munakata | 399/301 |

FOREIGN PATENT DOCUMENTS

| | | |
|---|---|---|
| EP | 0 494 105 A2 | 7/1992 |
| EP | 0 619 528 A1 | 10/1994 |
| EP | 0 679 018 A2 | 10/1995 |
| EP | 0 785 480 A2 | 7/1997 |
| EP | 0 608 124 B1 | 6/1998 |
| WO | WO 98/27472 | 6/1998 |
| WO | WO 98/39691 | 9/1998 |

OTHER PUBLICATIONS

Japanese Abstract, Publication No. 10139202 A, Date of Publication: May 26, 1998.
Japanese Abstract, Publication No. 60057040 A, Date of Publication: Apr. 2, 1985.

* cited by examiner

*Primary Examiner*—Sophia S. Chen
(74) *Attorney, Agent, or Firm*—Schiff Hardin LLP

(57) ABSTRACT

A method and apparatus for controlling a lateral position of a band-shaped intermediate image carrier in an electrographic apparatus by regularly detecting a mark on the intermediate image carrier with a sensor. The band-shaped intermediate image carrier is moved in a transport direction from an image generating position at which an image is generated on the image carrier to a transfer position at which the image is transferred. A transverse position of the intermediate image carrier relative to the transport direction is detected and is time correlated with the regular detection of the mark. Intermediate position detections are carried out between the regular detections of the mark in a time-controlled manner. The detected positions are compared to stored position values or calculated theoretical position values and the results of the comparison is used to control position correction devices which change the transverse position of the intermediate image carrier.

16 Claims, 8 Drawing Sheets

METHOD AND CONTROLLING MEANS FOR REGULATING THE POSITION OF A BAND-SHAPED IMAGE CARRIER IN AN ELECTROGRAPHIC APPARATUS

BACKGROUND OF THE INVENTION

1. Field of the Invention

The present invention is directed to a method and a controller for regulating the position of a band-shaped intermediate image carrier in an electrographic device. Such band-shaped intermediate image carriers are usually deflected via rollers. Since, due to manufacture, fluctuations in the roller geometries, fluctuations in their relative position with respect to one another and fluctuations in the band geometries cannot, however, be avoided, an intermediate carrier that is transported in unregulated fashion would drift out of its rated track transversely relative to the transport direction.

2. Description of the Related Art

Such an intermediate image carrier and such an electrographic printer device are disclosed, for example, by U.S. Pat. No. 4,061,222.

The intermediate carrier is an endless band that is conducted over a plurality of deflection rollers. The band comprises a light-sensitive, photoconductive layer on which an image can be generated with optical signals. The image is then inked with toner in a developer station in conformity with the optically applied information, and the image is transfer printed onto a recording medium at a transfer printing station.

The lateral position of the photoconductor band is regulated in the known printer device. To that end, a sensor is provided that acquires, or senses, a lateral edge of the photoconductor band. A motor operator for tilting a deflection roller is driven with the position signals and, thus, a control circuit is formed for the position of the band edge.

When the lateral position of the photoconductor band is regulated in that the actual position of the lateral band edge is monitored, then the regulated running track follows irregularities of the band edge. Dependent on the quality of the band edge, this leads to an unsteady and, thus, unfavorable running behavior of the band.

U.S. Pat. No. 4,959,040 likewise discloses a method and an apparatus for regulating the lateral position of a photoconductor band. Deviations of the band position from a rated track are thereby continuously corrected in that one of the rollers over which the band runs is tilted in a regulating process. In this system, disturbing quantities that are caused by irregularities of the band edge are compensated. It is thereby provided to durably apply marks onto the band at defined intervals over the entire circumference of the photoconductor band along a band edge. The band contour is determined in a measuring process in that an actuator of the track regulation, namely the tiltable deflection roller, is set or, respectively, tilted such that the band runs toward one side onto its rated position or, respectively, track. Over a complete band revolution, the applied marks are then acquired with a sensor, and the marked positions are stored as X-positions of the band. The lateral position of an edge of the band is sensed with a second sensor at every X-position. The Y-value that is thereby obtained is stored in a table as a value pair together with the appertaining X-value. The most recently stored X-value of the value pairs corresponds to the same position mark on the photoconductor band as the first X-value. Consequently, the difference between the first Y-value and the last Y-value corresponds to the amount that the band has run laterally off within the one revolution. The identified Y-values are then corrected by means of linear regression. The numerical table acquired in this way reflects the actual shape of the band edge. Every marked X-position of the band thus has a Y-rated value unambiguously allocated to it via the stored table values.

Irregularities in the sampled band mark can be compensated with the above-described method, and a relatively high track precision given quiet band running can be achieved. Since the respective course of the band edge is stored as a reference, greater tolerances in the band edge can be left standing then giving methods that do not acquire the band edge. What is disadvantageous in this method is that the precision of the acquired band contour is prescribed by the resolution of the mark supplied on the band. When one wishes to achieve a high resolution, then high-resolution marks are necessary, these in turn requiring a relatively great technical outlay.

European Patent Document EP-B1-608 124 discloses a method and an apparatus wherein the lateral position of a photoconductor band in an electrophotographic printer device is controlled with a control coefficient. The lateral excursions of the photoconductor band are thereby determined in a measuring process, these deriving when a deflection motor that acts on a deflection roller that deflects the band is moved in two opposite directions in succession by a specific number of steps proceeding from an initial position. A control coefficient is then identified from the measured excursions. For acquiring the band edge position, a plurality of notches are provided in the photoconductor band that form a Z-like shape. These notches are acquired with a transmitted light sensor. The deflection roller can implement both a swivel motion for varying the lateral band position as well as a linear motion along the band running direction for minimizing friction during the swivel motion. European Patent Document EP-A-785 480 discloses a further device for regulating the lateral position of an endless band in an electrophotographic printer device. Given this apparatus, the band is conducted over a deflection roller that, on the one hand, is tilted for regulating the lateral band position and, on the other hand, is connected to a drive motor for the band drive.

Further methods and devices for regulating the band velocity or, respectively, the band edge of endless bands are disclosed by U.S. Pat. No. 5,096,044, by U.S. Pat. No. 5,225,877, by Japanese Patent Document JP-A-10-139202, by European Patent Document EP-A1-619 528 and by U.S. Pat. No. 5,248,027. Another electrographic printer device is disclosed by Published PCT application WO-A-98/39691. Given this printer device, a latent image is generated on a photoconductor band, the image is then developed and transferred onto a transfer band. From this transfer band, finally, the image is transfer printed onto the recording medium, for example onto paper. Given this device, too, it is necessary that the lateral positions of the intermediate image carrier, particularly of the photoconductor band but also of the transfer band, are adhered to as exactly as possible. Published PCT Application WO-A-98/27472 discloses an electrographic printer having at least two developer units.

U.S. Pat. No. 5,515,139 discloses a sensor for sensing a band edge, whereby a mechanical sensing lever runs along at the band edge.

European Patent Document EP-A-0 679 018 discloses a method for regulating the lateral position of a band-shaped intermediate carrier, whereby the lateral positions of the edge profile are acquired as prescribed longitudinal positions in a revolution of the band and the lateral positions are stored together with the longitudinal positions. The lateral positions are averaged to average values in a plurality of successive revolutions of the band. In the regulating process, the difference between the actual value of the lateral position at the respective longitudinal positions and the appertaining average is formed in a revolution of the band. Dependent on this difference, the band is modified in its lateral guidance. Subsequently, a new average is formed in the fashion of a sliding average from the actual value of the lateral position and the appertaining average.

The documents EP-A-0 494 105, U.S. Pat. No. 5,903,805, JP-A-60057040 disclose methods wherein the lateral position of a band is influenced dependent on measured signals of a sensor that detects the edge of the band.

SUMMARY OF THE INVENTION

An object of the present invention is to provide a method and a system with which the lateral position of a band-shaped intermediate image carrier can be adhered to as exactly as possible in an electrographic device.

This object is inventively achieved with a method for regulating the lateral position of a band-shaped intermediate image carrier in an electrographic device that is moved along a transport direction from an image-generating position at which the image is generated on the carrier to a transfer printing position at which the carrier outputs the information corresponding to the image, whereby a mark on the intermediate image carrier is regularly acquired with a device-fixed sensor, the position of the intermediate image carrier transversely relative to the transport direction is acquired time-correlated with the acquisition of the mark, intermediate measurements of the position of the intermediate image carrier are implemented time-controlled between the regular acquisitions of the mark, the acquired position values of the intermediate image carrier are respectively compared to stored or calculated rated position values, and the comparison values are employed for driving position correction means with which the position of intermediate image carrier can be changed transversely relative to the transport direction, whereby a plurality of position values of the lateral band edge are registered for determining the rated position values in a measurement event over a complete band revolution, whereby the first position is acquired a first time at the beginning of the band revolution and a second time at the end of the band revolution, the difference between the two position values of the first position is formed and correction values are formed therefrom for determining the actual course of the band edge, and whereby the correction values for the remaining positions of the band edge are determined by linear regression from the difference between the two measured values of the first position and from the spacings of the positions in band transport direction.

As a further improvement of the method, the intermediate image carrier is an endless band, and the mark is acquired only once per revolution of the endless band. In a preferred embodiment, clock signals are generated for the time-control of the intermediate measurements. The clock frequency of the clock signals may be selected from a plurality of frequencies.

Advantages are provided wherein the mark comprises a first edge that proceeds essentially perpendicularly to the transport direction of the intermediate image carrier and comprises a second edge that proceeds inclined relative to the first edge. The method may provide that the intermediate image carrier is transported with a constant velocity. In one application of the invention, the intermediate image carrier is a photoconductor.

The position correction means comprise a tiltable roller that serves as deflection roller for the intermediate image carrier, according to one development. A motor that effects a tilting of the roller is driven on the basis of the comparison values according to a further development.

The invention also provides an apparatus for the implementation of the method set forth above for regulating the lateral position of a band-shaped intermediate image carrier in an electrographic device that is moved along a transport direction from an image-generating position at which the image is generated on the carrier to a transfer printing position at which the carrier outputs the information corresponding to the image, whereby means are provided with which a mark on the intermediate image carrier is regularly acquired with a device-fixed sensor, the position of the intermediate image carrier transversely relative to the transport direction is acquired time-correlated with the acquisition of the mark, intermediate measurements of the position of the intermediate image carrier are implemented time-controlled between the regular acquisitions of the mark, the acquired position values of the intermediate image carrier are respectively compared to stored or calculated rated position values, and the comparison values are employed for driving position correction means with which the position of intermediate image carrier can be changed transversely relative to the transport direction, whereby a plurality of position values of the lateral band edge are registered for determining the rated position values in a measurement event over a complete band revolution, whereby the first position is acquired a first time at the beginning of the band revolution and a second time at the end of the band revolution, the difference between the two position values of the first position is formed and correction values are formed therefrom for determining the actual course of the band edge, and whereby the correction values for the remaining positions of the band edge are determined by linear regression from the difference between the two measured values of the first position and from the spacings of the positions in band transport direction, whereby the intermediate image carrier is guided over a deflection roller held in a frame, the deflection roller being linearly movable along a direction and being swivellable around an axis that, in particular, is parallel to the linear moving direction for regulating the lateral band position, whereby a first guide is provided for the linear motion and a second guide is provided for the swivel motion.

According to a further development of the apparatus, the second guide comprises a guide surface firmly connected to the frame and on which a bearing element rolls play-free. The frame may be pre-stressed against the rocker with a spring. The position of the lateral edge of the intermediate image carrier may be acquired with a mechanical sensing sensor, whereby a lever provided with a permanent magnet lies against the band edge under pres-stress and the measured signals thereof are generated by a Hall sensor, for example. In one embodiment, a notch punched into the lateral band edge is acquired as a mark on the intermediate image carrier.

The present invention finds application in an electrographic printer or copier device, for example. The invention, according to one aspect, provides a system for regulating the lateral position of a band-shaped intermediate image carrier in an electrographic device that is moved along a transport direction from an image-generating position at which the image is generated on the carrier to a transfer printing position at which the carrier outputs the information corresponding to the image, whereby means are provided that effect that a mark on the intermediate image carrier is regularly acquired with a device-fixed sensor, the position of the intermediate image carrier transversely relative to the transport direction is acquired time-correlated with the acquisition of the mark, intermediate measurements of the position of the intermediate image carrier are implemented time-controlled between the regular acquisitions of the mark, the acquired position values of the intermediate image carrier are respectively compared to stored or calculated rated position values, and the comparison values are employed for driving position correction means with which the position of intermediate image carrier can be changed transversely relative to the transport direction, a plurality of position values of the lateral band edge are registered for determining the rated position values in a measurement event over a complete band revolution, whereby the first position is acquired a first time at the beginning of the band revolution and a second time at the end of the band revolution, the difference between the two position values of the first position is formed and correction values are formed therefrom for determining the actual course of the band edge, and the correction values for the remaining positions of the band edge are determined by linear regression from the difference between the two measured values of the first position and from the spacings of the positions in a band transport direction.

In a first aspect, the invention provides that a mark is regularly acquired with a device-fixed sensor for regulating the lateral position of a band-shaped intermediate carrier, the lateral position of the intermediate image carrier transversely relative to the transport direction is acquired time-correlated with the acquisition of the mark, and intermediate measurements in the position of the intermediate image carrier are implemented time-controlled between the regular acquisition of the mark. The acquired position values of the intermediate image carrier are respectively compared to stored or calculated rated position values, and the comparison values are employed for driving position correction means with which the position of intermediate image carrier can be changed transversely relative to the transport direction.

Compared to known, regulated devices, the first aspect of the invention achieves an improvement in that a single mark on the intermediate image carrier suffices and a high guidance position can nonetheless be achieved. In that the mark is employed as a trigger mark that triggers the intermediate measurements or, respectively, controls these in time, only a few marks or possibly even a single mark on the band-shaped intermediate image carrier suffice in order to regulate its lateral position (transversely relative to the band running direction) and/or its position in the band running direction with high precision. The sampling locations along the band edge that derive as a result of this time control fundamentally allow an arbitrarily high position determination that is essentially defined by the time control, particularly by the frequency of the intermediate measurements triggered with the trigger mark or, respectively, trigger marks.

In particular, the signals of a timer, for example of a high-frequency quartz resonator, are particularly suitable for defining the points in time of the intermediate measurements.

In an advantageous embodiment of the invention, the intermediate image carrier is moved along the transport direction with a constant velocity. Constant time pulses for the intermediate measurements then correspond to constant intervals (positions) on the intermediate image carrier. The lateral band guidance can be achieved with all the greater precision the smaller the fluctuations in synchronism of the band are. Conversely, the invention also allows conclusions about the band running in the transport direction in that the position of the trigger mark is synchronized with the signals of the timer. As a result of this mutual condition of the measuring precisions in the transport direction and transversely relative to the transport direction, a high-precision, self-stabilizing band transport system can be achieved with relatively little outlay.

With the inventive method, the running track of an endless band is monitored by continuously sampling a band edge. Deviations from the rated track are thereby continuously corrected in that one of the rollers over which the band runs is tilted in a suitable way.

In a second aspect of the invention, which can also be utilized independently of the aforementioned, first aspect of the invention, a band-shaped intermediate image carrier is provided with structured marks that lie in a track along the running direction of the band. In particular, they can lie periodically or statistically at a well-defined space from the lateral band edge. The marks comprise one or more edges slanting relative to the perpendicular of the running direction, at least two edges thereof being not parallel. The marks are periodically sensed with a sensor that comprises a plurality of measuring points along the transport direction. In particular, opto-electronic line cameras, for example, CCD lines (CCD=charge coupled device) are suited as a sensor. With the assistance of an electronic triggering or on the basis of a short-term illumination, the spatial edge spacing within the track sampled by the line camera is imaged via a suitable optical device, for example by a lens, an objective or an optical fiber conductor, on the detector as a snapshot.

The mark thereby comprises at least one edge that is inclined such relative to the transport direction of the intermediate image carrier that it is not perpendicular to it. For evaluation, it is particularly advantageous to provide two edges that are in turn inclined relative to one another, these being interpreted on the basis of the geometrical image according to geometrical methods, particularly triangulation. The marks are preferably triangle marks.

What can be achieved with the second aspect of the invention is that the position of the band-shaped intermediate image carrier both in the transport direction as well as perpendicular to the transport direction can be exactly measured with a single sensor in the region of the mark. The second aspect of the invention also makes it possible to identify both the positions as well as the velocity of the band in the transport direction with high precision using relatively little sensor outlay.

In a third aspect of the invention, that can also be considered independently of the two other aspects of the invention, a device for tensioning an endless band is provided. The device comprises a deflection roller for deflecting the band that can be linearly moved along a first axis for compensating tolerance in the band length and can be pivoted around a second axis for regulating the lateral band position. The two axes can lie parallel to one another, being particularly even identical, but can also lie inclined relative to one another, particularly perpendicularly relative to one another. The two movements of the deflection roller can be implemented via a lever arrangement but decoupled from one another in that two mutually separate guides are provided for the linear motion on the one hand and for the swivel motion on the other hand. The linear motion can be supported with a spring that acts opposite the band tension. The swivel motion ensues with a drive that is connected play-free to the drum. The freedom from play is particularly achieved by a pre-stressed slideway. For example, a cam (or eccentric) that is directly connected to the drive can thereby roll off on a lever arrangement that engages at the deflection roller, the lever arrangement being pre-stressed relative to the cam with a spring.

A regulated drive for the swivel motion may be provided. A sensor can be provided for the regulation that senses the lateral edge of the band-shaped image carrier. A mechanical touch sensor provided with a Hall sensor can be employed for sensing the lateral band edge.

The third aspect of the invention enables the high-precision, regulated positioning of the deflection roller both in the band running direction as well as transversely relative to the band running direction and, thus, enables a precise position of the intermediate carrier band in the ongoing operation of the printer or copier.

A fourth aspect of the invention is directed to a sensor for sensing the position of the lateral edge of a band-shaped material, particularly of an intermediate image carrier. The sensor is fashioned as a mechanical sensing sensor, whereby a lever provided with a permanent magnet lies against the band edge with pre-stress and the measured signals thereof are generated by a Hall sensor.

The sensor design according to the fourth aspect makes it possible to sample a lateral band position in an analog fashion without employing an optical sensor. As a result thereof, the risk of an outage of the sensor due to dust being deposited thereon is minimized. In contrast to an edge regulation with limit switches, such a sensor cannot only realized a two-point regulation but can also realize proportional-integral-differential regulation (PID). The sensitivity of the sensor can be set by the position of the operating point. Given a suitable selection of the Hall sensor, further electronic amplification of the sensor signal can be foregone. By employing the Hall sensor, a high dependability against malfunction in view of electromagnetic pulses from other component parts derives since the sensor is highly insensitive here.

BRIEF DESCRIPTION OF THE DRAWINGS

Exemplary embodiments of the invention are described in greater detail below on the basis of some Figures.

DETAILED DESCRIPTION OF THE PREFERRED EMBODIMENTS

Figure 1:
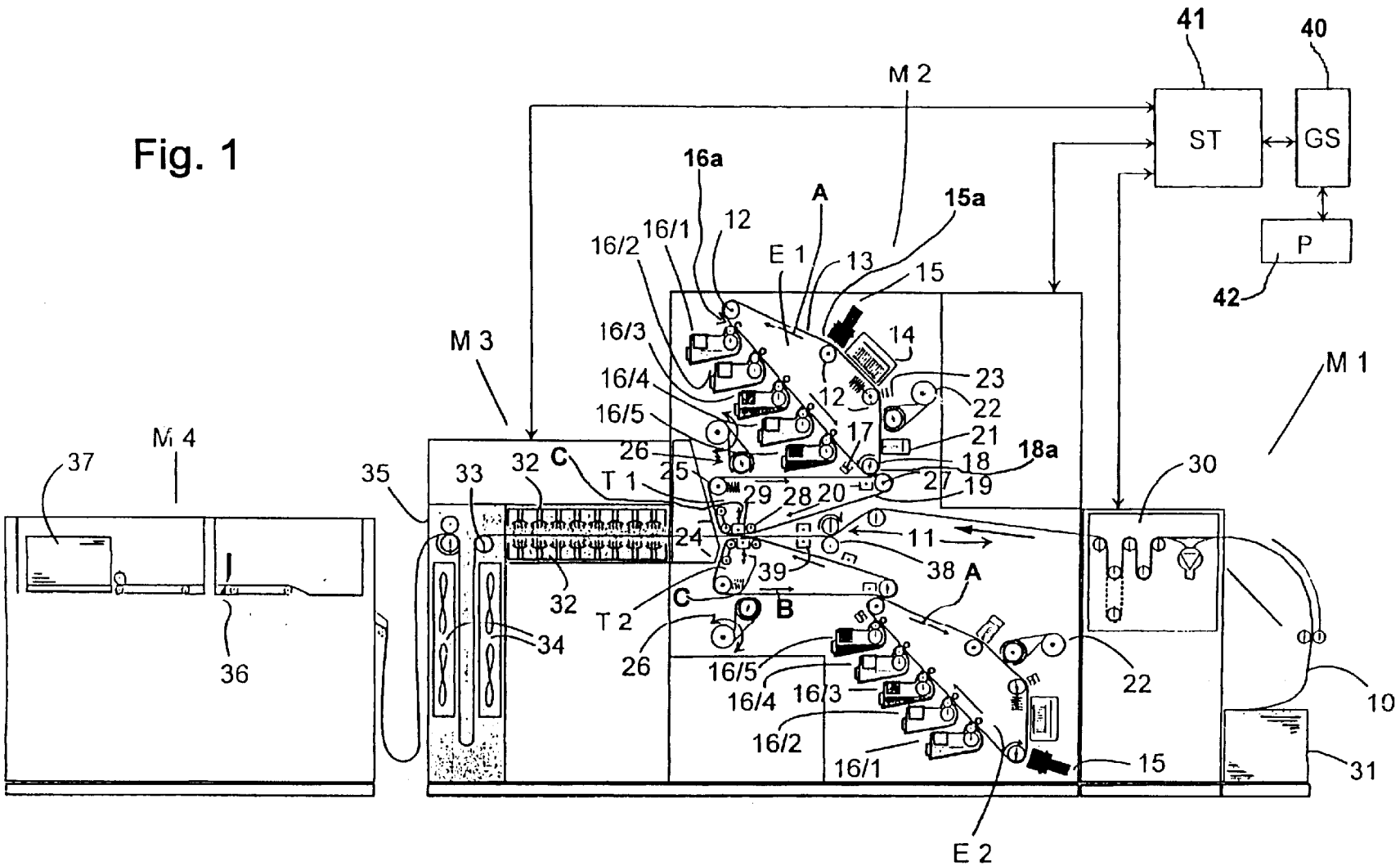
FIG. 1 is a schematic sectional view of an electrophotographic printer device for printing a band-shaped recording medium.

The printer device for performance-adapted, monochromatic and/or chromatic, single-sided or both-sided printing of a band-shaped recording medium 10 shown in FIG. 1 is modularly constructed and fundamentally comprises a feeder module M1, a printer module M2, a fixing module M3 and a post-processing module M4. This printer device is disclosed by PCT Published Patent Application WO-A-98/39691. The content of this WO publication is herewith incorporated by reference into the present specification. The feeder module M1 of the printer device contains the elements for feeding, for example, a continuous form paper 10 pulled off from a stacker to the printer module M2. The printer module M2 contains electrophotographic printing units that print the recording medium 10, i.e. the paper web. The recording medium 10 is then fixed in the fixing module M3 and is cut or, respectively, stacked in the post-processing module M4.

The printer module M2 contains the units required for printing a band-shaped recording medium 10 with toner images, these being arranged at both sides of a transport channel 11 for the recording medium 10. These units are essentially composed of two differently configurable electro-photography modules E1 and E2 with appertaining transfer modules T1 and T2. The modules E1 and T1 are thereby allocated to the front side of the recording medium 10, and the modules E2 and T2 are allocated to the backside thereof. The identically constructed electrophotography modules E1 and E2 each respectively contain a seamless photoconductor band 13 conducted over deflection rollers 12 and driven electro-motively in an arrow-direction A, for example an organic photoconductor (OPC). A drive motor that acts on one of the deflection rollers 12 is provided for driving the band 13. The units for the electrophotographic process are arranged along the light-sensitive outside of the OPC band 13. They serve the purpose of generating toner images allocated to individual color separations on the photoconductor. For this purpose, the photoconductor moved in the arrow direction A is first charged to a voltage of approximately −600 V with the assistance of a charging device 14 and is then discharged to approximately −50 volts at a position 15*a* in a fashion dependent on image information with the assistance of a character generator 15 composed of a LED comb. The latent charge image generated in this way and situated on the photoconductor is then inked with toner with the assistance of developer stations 16/1 through 16/5 at corresponding developing positions, for example at the position 16*a* for the station 16/1. Subsequently, the image is loosened with the assistance of the intermediate exposure device 17 and is transferred onto a transfer band 19 of the transfer band module T1 with the assistance of a transfer corona device 20 at a transfer printing position in a transfer printing station 18*a* by means of transfer printing rollers 18. Subsequently, the entire photoconductor band is discharged over its entire width with the assistance of the discharge corona device 21 and is cleaned of adhering toner dust via a cleaning device 22 having a cleaning brush. A subsequent intermediate exposure device 23 sees to a corresponding charge-wise conditioning of the photoconductor band, which, as already set forth, is uniformly charged then with the assistance of the charging device 14.

Toner images allocated to individual color separations of the color image to be produced are generated with the electrophotography module E1 or, respectively E2. To this end, the developer stations 16/1 through 16/5 are fashioned to be switchable. They respectively contain the toner allocated to an individual color separation. For example, the developer station 16/1 contains black toner, the developer station 16/2 contains yellow-colored toner, the developer station 16/3 contains magenta-colored toner, the developer station 16/4 contains cyan-colored toner, and, for example, the developer station 16/5 contains blue toner or toner of a special color. Both one-component as well as two-component toner developer stations can be employed as the developer stations.

In order to achieve the switchability of the developer stations, i.e. in order to be able to individually actuate each individual developer station, these, given the employment of fluidizing toner, can be fashioned, for example, according to the Published PCT Application WO-A-98/27472. The switching of the developer station thereby ensues by modifying the electrical bias of the transfer drum or, respectively, by modifying the electrical bias of the applicator drum. It is also known to switch the developer stations in that they are mechanically shifted and are thereby brought into contact with the photoconductor band 13. Such a principle is disclosed, for example, by German Patent Document DE-A-19618324.

During operation of the printer device, a toner image that is allocated to a single color separation is generated via the developer stations 16/1 through 16/5, respectively always being generated by a single developer station. This toner image is then electrostatically transferred onto the transfer band 19 of the transfer module T1 via the transfer printer device 18 in conjunction with the transfer corona device 20. The transfer module T1 contains the transfer band 19 that is composed of polyimide or a similar substance and that is conducted over a plurality of deflection devices and is motor-driven. The transfer band 19 is fashioned similar to the photoconductor band 13 both endlessly and seamlessly. It is moved in an arrow direction B, namely proceeding from the transfer region with the drum 18 and the transfer corona device 20 to a transfer printing station 24 and from the latter via deflection roller 25 to a cleaning station 26 and from the latter to the transfer region 18*a* and 20 with the deflection roller 27 arranged thereat.

The transfer band 19 in the transfer module T1 functions as collector for the individual toner images allocated to the color separations that are transferred onto the transfer band 19 via the transfer device 18 and 20. The individual toner images are thereby arranged on top of one another so that an overall toner image corresponding to the color image arises. In order to be able to generate the overall color toner image and then transfer it onto the front side of the recording medium 10, the transfer module T1 contains a switchable transfer printing station 24. Corresponding to the illustration of FIG. 1, this can contain a plurality of mechanically displaceable transfer printing drums 28 with an appertaining transfer printing corona device 29. In the "collecting" operating condition, the transfer printing drums 28 and the transfer printing corona 29 are shifted upward in conformity with the arrow direction C, so that the transfer band is spaced from the recording medium 10. The individual toner images are then taken from the electrophotography model E1 in this condition and superimposed on the transfer band 19. The cleaning station 26 is deactivated by being swivelled out. The recording medium 10 is at rest in the region of the transfer printing station 24 in this operating condition.

The electrophotography module E2 and the transfer module T2 for the backside of the recording medium 20 are constructed corresponding to the modules E1 and T1. Here, too, a collective color toner image for the backside is generated on the transfer band T2, whereby the corresponding transfer printing station 24 is also swivelled here in the "collecting" operating condition.

For simultaneous printing of the front and back sides of the recording medium 10, the transfer bands 19 of the transfer modules T1 and T2 are simultaneously brought into contact with the recording medium 10 in the region of their transfer printing stations 24 and the recording medium 10 is thereby moved. At the same time, the cleaning stations 26 of the transfer modules T1 and T2 are swivelled in and activated. After transferring the two toner images onto the front or, respectively, backside of the recording medium 10, toner image residues adhering to the transfer bands 19 are removed via the cleaning stations 26. This is in turn followed by a collecting cycle for generating new toner images, whereby the transfer bands 19 are swivelled out and the recording medium 10 is standing still. The transfer of the toner images from the transfer modules T1 and T2 onto the recording medium 10 thus ensues in start-stop mode of the recording medium.

The recording medium 10 is moved in the paper transport channel 11 with the assistance of motor-driven transport rollers 38. Charging devices or, respectively, corona devices 39 for paper conditioning can be arranged in the region between the transport rollers 38 and the transfer printing stations 24 so that the paper 10 is uniformly set in terms of charge, for example, before the transfer printing.

So that the recording medium 10 composed of paper does not tear given this start-stop mode and can also be continuously supplied, the feeder module M1 contains a loop-drawing means 30. This loop-drawing means 30 serving as a band store which buffers the recording medium 10 that is continuously taken from a stacking device 31.

After the transfer printing of both chromatic toner images in the region of the transfer printing stations 24 onto the recording medium 10, these must still be fixed. The fixing modules M3 serves this purpose. It contains an upper and lower row of infrared radiators 32 between which the paper transport channel for the recording medium 10 proceeds. Since a loose toner image is situated both on the front side as well as on the backside of the recording medium, the recording medium 10 is freely guided in the region of the infrared radiators 32 in non-contacting fashion via a deflection roller 33 arranged at the output side. The fixing ensues via the heat of the infrared radiators 32. A cooling of the recording medium 10 as well as a smoothing, for example via corresponding de-curler devices, ensue in a cooling path following the infrared radiators 32 and having cooling elements 34 and deflection rollers 35. Blower-driven air chambers can serve as cooling elements 34.

After fixing both toner images and cooling, a corresponding post-processing of the recording medium 10 ensues within the framework of the post-processing module B4 that, for example, can contain a cutter device 36 with a stacking device 37.

The printer was described above on the basis of the printer mode of duplex and color. Given this operating condition, color images are printed on both sides on the recording medium 10 operated in a start-stop mode. This operating mode is the slowest. In the framework of a job to be processed, the printing is carried out in a single-color in simplex or duplex mode for the overwhelming majority of the time. In this operating mode, the recording medium 10 is continuously moved and the transfer stations T1 and T2 are continuously in contact with the recording medium. Only one developer station of the developer module E1 or, respectively, E2 is activated, this respectively generating a one-color toner image that is immediately transferred onto the transfer bands 19 and from the latter onto the recording medium 10. The transfer bands 19 thereby operate as immediate transfer elements without a collecting function. For this reason, the cleaning stations 26 are continuously activated.

The printer device is thus constructed so as to be performance-adapted. This means that it is adapted to the most frequently occurring printing, which is monochromatic printing, and is especially fast due to the continuous operation. When color printing is desired, a switch is made to a start-stop mode and the required time outlay is dependent on the number of colors contained in the color image and, thus, dependent on the number of developer stations 16/1 through 16/5 which are activated. When, for example, only two colors are printed, for example black with red in a spot color method, then only two transfer processes with their collecting processes are required in the developer module E1 and in the transfer module T1 for the presentation of the collective toner image. The similar case applies given three colors, etc.

Depending on the activation of the various modules, different other operating modes can be produced in the printer. For example, a chromatic simplex mode is provided by activating developer module and transfer module only at the corresponding, desired side of the recording medium or, on the other hand, a mixed mode may be provided, whereby, for example, multi-colored images are printed onto the front side and monochromatic images are printed onto the backside.

A controlled device 41 (ST) that is microprocessor-controlled and coupled with the device controller 40 (GS) of the printer serves the purpose of realizing these various operating conditions, the control device 41 being in communication with the components to be controlled and regulated, namely the feeder module M1, printer module M2 and the fixing module M3 or, respectively, the post-processing module M4. Within the modules, it is coupled to the individual units, thus, for example, with the electrophotography modules E1 and E2 and the transfer modules T1 and T2. A control panel 42 (P) via which the various operating conditions can be input is connected to the device controller 40 or, respectively, the control 41, which can be a component part of the device controller. The operating panel 42 can contain a touch screen picture screen or, respectively, a personal computer (PC), for example a Siemens Nixdorf Scenic Pro B7-PC with a coupled keyboard. The control itself can be of a conventional construction.

Figure 2:
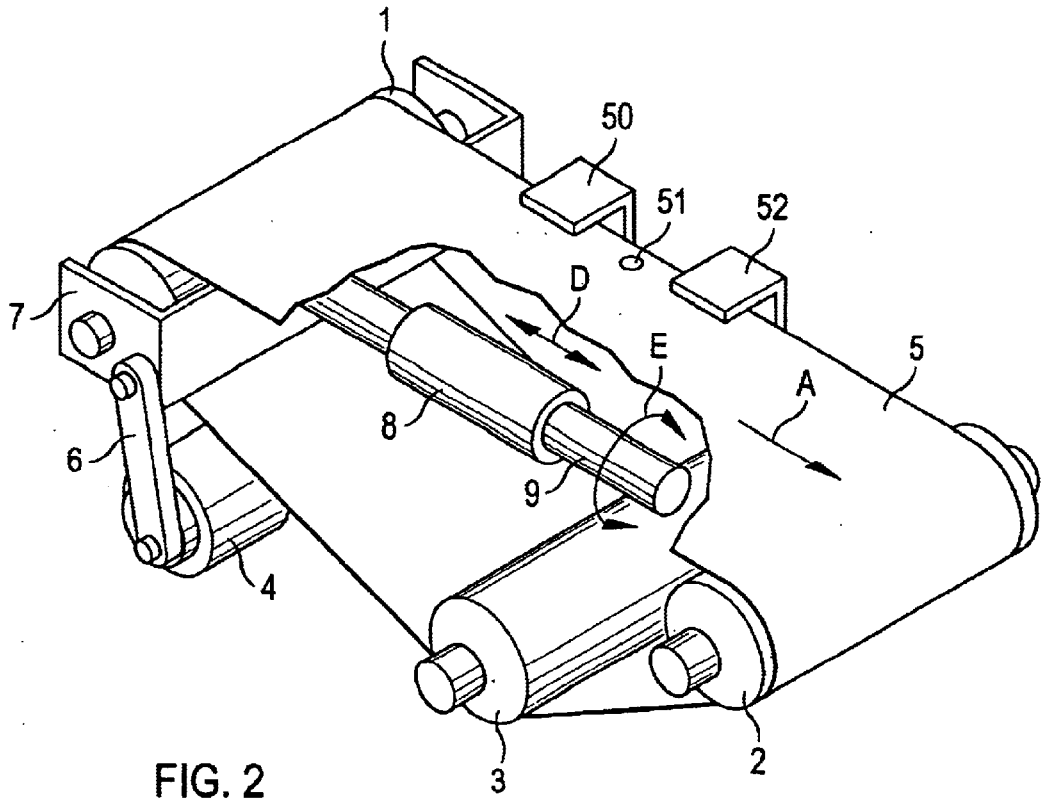
FIG. 2 is a perspective view of a drive and control device for an endless band.

FIG. 2 shows an apparatus wherein an endless band 5 runs over three deflection rollers 1, 2 and 3. The first deflection roller 1 is thereby fashioned as a control or, respectively, regulating roller and, in addition to having the deflection function, serves the purpose of stabilizing the band running. The regulating roller 1 is secured in a rotating frame 7 for this purpose, this being seated to be pivotable and displaceable. For tensioning the band 5, the rotating frame 7 can be displaced in a direction D in the linear guide 8 wherein the guide axis runs. Moreover, the guide axis 9, which is rigidly connected to the rotating frame 7, can be swivelled in a direction E. Due to the swiveling or, respectively, skewing of the live frame 7 or, respectively, of the regulating roller 1 relative to the two other deflection rollers 2 and 3, the intermediate carrier band 5 can be laterally guided, i.e. perpendicular to the band transport direction A. The drive of the band 5 ensues with a drive motor that acts on at least one of the drums 1, 2 or 3. The drive motor, in particular, is driven in regulated fashion, whereby signals above the actual band velocity enter into the regulation, these being generated with the mark sensor 52.

The swiveling of the regulating roller 1 ensues via a motor operator 4 that is connected to the rotating frame 7 with a connecting link 6. For acquiring the lateral position, it suffices for the present invention to apply a single mark 51 the intermediate carrier band 5—which, for example, can be the photoconductor band 13 or the transfer band 19 of FIG. 1. This mark 51 is employed as a trigger mark for controlling the running position (regulation of the lateral band edge to a specific position). The sampling locations along the band edge, proceeding from the trigger mark 51, are thereby defined by a time control. Fundamentally, an arbitrarily high resolution can thereby be achieved. The pulses for sampling the band edge, which correspond to a X-position on the band, are prescribed by the signals from a timer. Given a constant band velocity, the constant time pulses correspond to constant intervals (the X-position on the band 5. Assuming an adequately high synchronism of the band 5, deviations from the defined sampling location (the X-position) on the band will be adequately small. The arising measuring error when sampling the band edge via this time control is thus negligible given an adequately precise synchronism of the band. In order to prevent the measuring positions from drifting away over time, the sampling is synchronized with the trigger mark 51 once per band revolution.

The lateral band position perpendicular to the band transport direction A, i.e. a Y-position, is measured at each X-position (in the direction A) of the band 5 prescribed by the timer pulses. The passing of the trigger mark 51 is measured with the sensor 50 and, thus, the revolution time for one band revolution is acquired.

Figure 3:
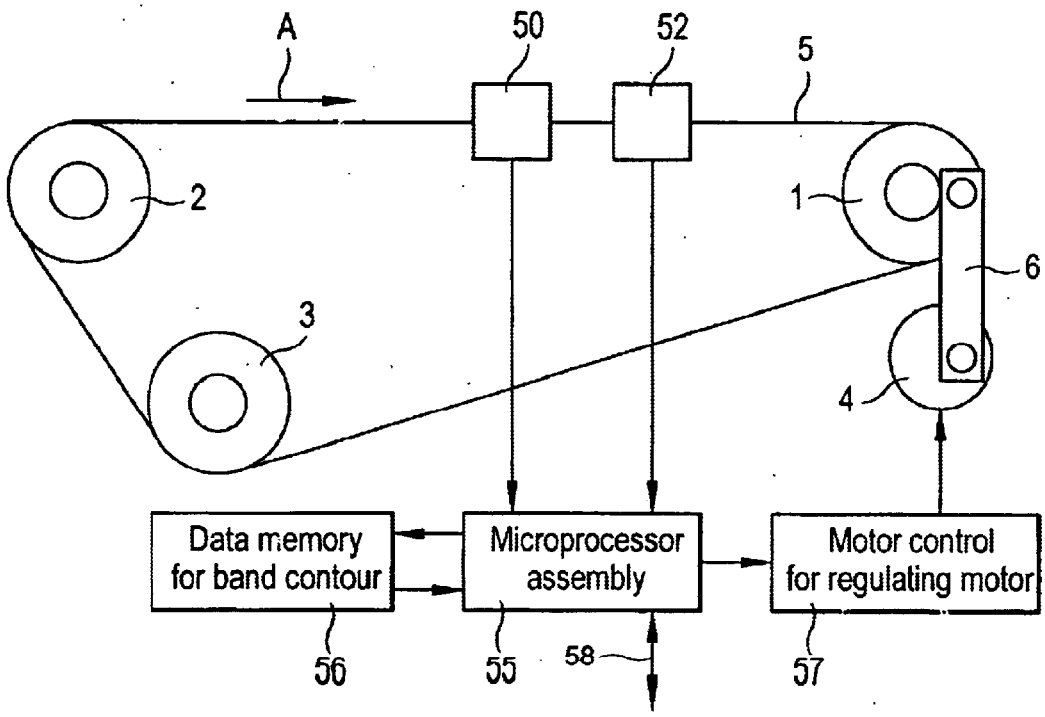
FIG. 3 is a functional block diagram of electronic components of a drive and control device.

FIG. 3 shows the essential electronic components of the arrangement again. The sensors 50 and 52 send the signals they acquire to a microprocessor assembly 55. This assembly 55 contains, among other things, a pulse generator (timer) that outputs signals at chronologically constant intervals, the band edge sensor 52 sensing the band edge at the signals. The microprocessor assembly 55 is connected via a line 58 to the device controller 40. The microprocessor assembly 55 compares the measured band edge values (the Y-positions) and the appertaining X-position derived from the sensors with the mark sensor 50 to rated value pairs (S, Y) of a data store 56. When the Y-value measured by the sensor 52 deviates from the corresponding Y-value stored in the data store 56, then a regulating pulse is forwarded to the motor control 57 via the microprocessor assembly 55 in order to actuate the motor operator 4, so that the lateral band position of the band 5 is corrected.

In particular, an electromechanical sensor is suitable as the sensor for sensing the band edge, whereby a mechanical lever lies against the band edge under the action of a spring and a lateral band motion acts via the lever on an electronic circuit, for example inductively or capacitatively. Electronic parameters of the circuit such as, for example, inductance or capacitance then change due to the lever motion, as a result whereof the sampling signal is generated. However, opto-electronic sensors such as, for example, reflected light or transmitted light barriers or CCD cameras are also suitable both for the sensor 50 as well as for the sensor 52.

Figure 4:
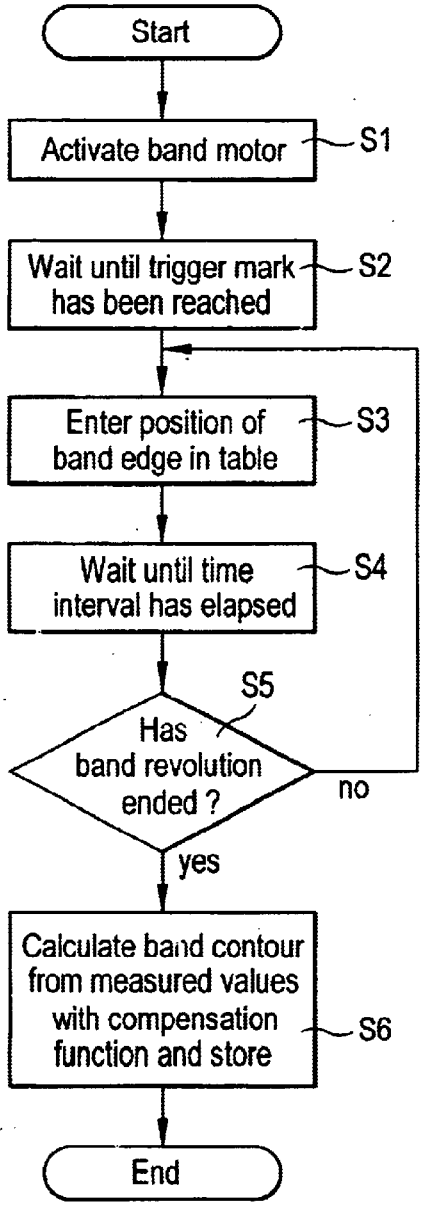
FIG. 4 is a flow chart for determining a band contour.

The method with which the band contour is determined is now described on the basis of FIG. 4 the rated positions $_x$0 and $_y$0 are stored in the data storage 56 as value pairs and correspond to the band contour. In Step S1, a band motor is activated, this driving one of the rollers 1, 2 or 3 and moving the band 5 forward in a direction A. The sensor 50 monitors the band running. The microprocessor control 55 now waits until the sensor 50 acquires the trigger mark 51 on the band 5, i.e. the trigger mark has arrived at the sensor 50 (Step S2). This position simultaneously marks the first rated value $_x$0 in the x-position. The current Y-position of the lateral band edge, which was acquired with the sensor 52, is likewise sampled at this value and is registered in the table 56 together with the appertaining X-value (Step S3). Simultaneously, the timer is started in the microprocessor 55, and the next value pair is entered into the data store 56 on the continuously moving band following the first time interval or, respectively, with the pulse output by the timer. The X-position of the band is thereby calculated from the time (frequency) prescribed by the timer and the momentary band velocity of the band 5. The Y-value is in turn determined with the band edge sensor 52 (Step S4). The Steps S3 and S4 are repeated until the band revolution has ended, i.e. until the trigger mark 51 has arrived again at the sensor 50 (Step S5). According to Step S6, the value pairs of the previously sampled band revolution must now still be corrected to the effect that a lateral drift of the band must be subtracted in order to deposit the actual band contour in the data store 56. To this end, the first and the last Y-value, that respectively lay at the same X-location, i.e. at the trigger mark 51 of the band 5, are utilized. The difference between the first Y-value and the last Y-value corresponds to the amount by which the band 5 has run laterally away within one revolution. The identified Y-values can thus be simply corrected by linear regression. The value table (X, Y) acquired in this way then indicates the actual shape of the band edge. Every identified X-position of the band thus has a Y-rated value unambiguously allocated to it via the stored table.

Figure 5:
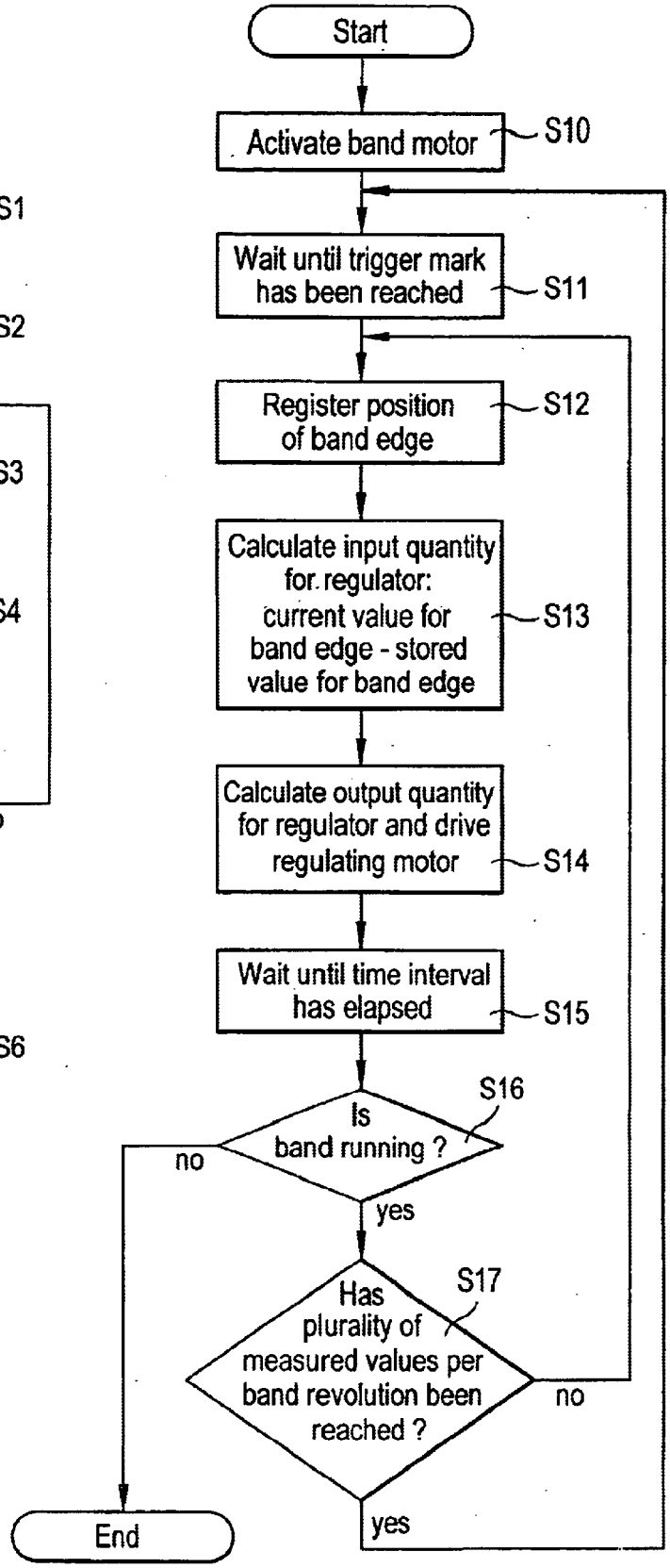
FIG. 5 is a flow chart directed to the regulation of a band position.

FIG. 5 now describes how the lateral band running is maintained during the operation of an electrographic device in which an endless band runs. In Step S10, the band motor is activated, corresponding to Step S1. The microprocessor control 55 then again waits until the trigger mark 11 has arrived at the mark sensor 50 (Step S11). The current position of the band edge is then registered with the edge sensor 52 (Step S12). The difference between the currently measured Y-value of the band edge and the Y-value $_y$0 (the value belonging to the trigger mark) is then formed in Step S13. This difference value enters into the following regulating process as an input quantity. In this regulating process (Step S14), a drive value for the motor operator 4 is formed with which the circulating band 5 is to be shifted into the rated position, i.e. in the direction toward the stored Y-rated value. The regulator can be fashioned as a proportional regulator or as a proportional-integral regulator as well.

In step S15, one again waits for the time interval prescribed by the timer or, respectively, its pulses and checks whether the band is still running (Step S16). When the band is standing still, then the regulating process is ended. When the band is still running, then a check is carried out to see whether the number of measured values for a complete band revolution has been reached. When this is the case, then the Step S11 is implemented again, i.e. a wait is carried out until the trigger mark is reached again. When, in contrast, it is found in Step S17 that the measured values of the band revolution are not yet complete, then Step S12 follows until the band revolution has been ended. As a result of the continuous sampling of the band edge and readjustment of the band edge onto the identified reference track (corresponding to the X Y-values stored in the store 56), the drifting of the band can be kept to a minium. Irregularities in the sampled band edge do not affect the track precision of the band guidance. This means a significant improvement of the band guidance precision compared to methods wherein the lateral band position is measured and readjusted only once per band revolution or wherein irregularities of the band edge are not taken into consideration given continuous readjustment. Since the respective shape of the band edge is stored as a reference, the edge contour can lie within rough tolerance limits and can be significantly less precise than the track precision of the band to be achieved. As a result thereof, manufacturing costs for the band or, respectively, for a high-precision tailoring of the band edges can be eliminated.

Another advantage of the invention is that only a single band marking suffices in order to nonetheless have a continuous sampling or, respectively, a sampling dependent only on the timing intervals ensue over the entire band circumference. The sampling frequency can be very simply adapted to higher or lower resolution demands by simple modifications, particularly in a software running in the microprocessor. Given an imprecisely cut band edge, the track precision can be enhanced further by increasing the sampling frequency.

Figure 6:
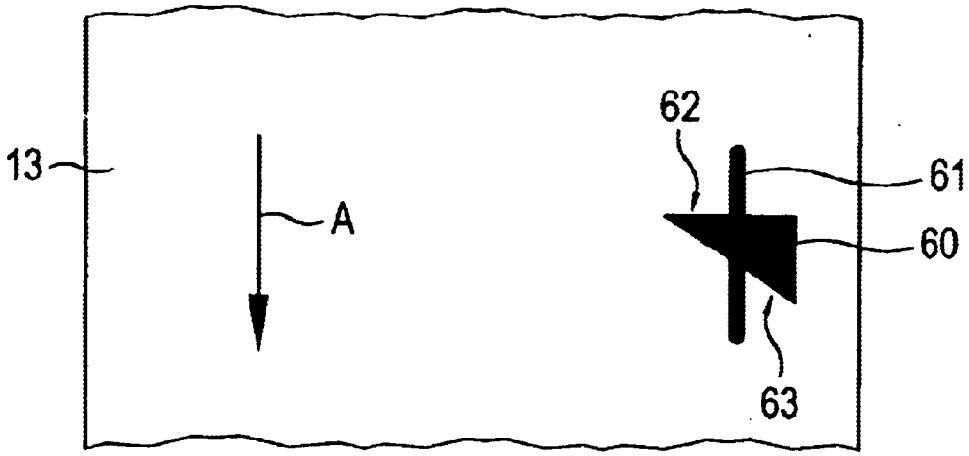
FIG. 6 is a schematic diagram of a band provided with a triangle mark.

FIG. 6 illustrates the principle underlying the second aspect of the invention. A triangle mark 60 is applied on a band-shaped intermediate image carrier, which here is a photoconductor band 13, which moves along a direction A. The mark 60 comprises a first edge 62 perpendicular to the running direction A as well as a second edge 63 proceeding at an angle relative to the running direction A. The mark 60 thereby forms a triangle shape. The mark 60 can be fashioned as a mechanical recess in the band 13 or can merely be applied on the band as a fine surface structure, whereby such structures can be applied, for example, by laser ablation, laser coating, by vapor-deposition or deposition, plasma etching, wet chemical etching or, as well, as optical mark by development of a photographic process.

A position-sensitive detector 61 is provided for evaluating the mark 60. Dependent on the fashioning of the marks 60, a corresponding sensor is to be provided that recognizes this mark 60 on the band 13. An optical mark 60 is sampled, for example, with a photo-electric sensor, with a CCD line camera in the example of FIG. 6. The line camera 61 can comprise an optical device, for example a lens, an objective or an optical fiber conductor, with which the mark on the band is sharply imaged onto the camera sensors.

A finding is made with a snapshot as to where the mark 60 is located relative to the line camera 61 at a specific point in time. The snapshot is produced with an electronic triggering and/or with a short-term illumination (photoflash). Deviations of the band position, i.e. of the reference mark 60, relative to a rated position can then be unambiguously detected with the detector 61. To this end, the line camera 61 is dimensioned such with respect to the transport direction A that it can reliably recognize the mark 60 along the transport direction within an anticipated range of deviation of the band running. When, for example, it is to be anticipated that the band can have position deviations of approximately 1 millimeter per revolution, then the line detector must cover at least one millimeter on the band.

When the entering edge 62 of the mark 60 lies perpendicular to the moving direction A, then it can be utilized for triggering the measurement itself, as a trigger point for determining an overall revolution of the band 13 or of some other event, for example for determining the velocity.

Figure 7A:
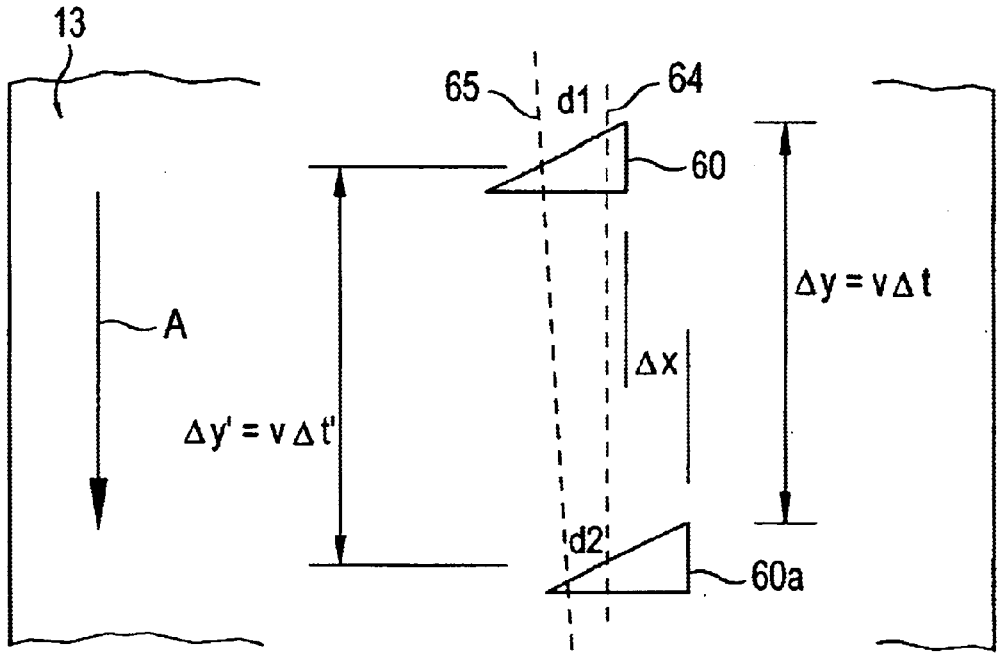
FIGS. 7*a* and 7*b* are illustrations related to the interpretation with two triangle marks.
Figure 7B:
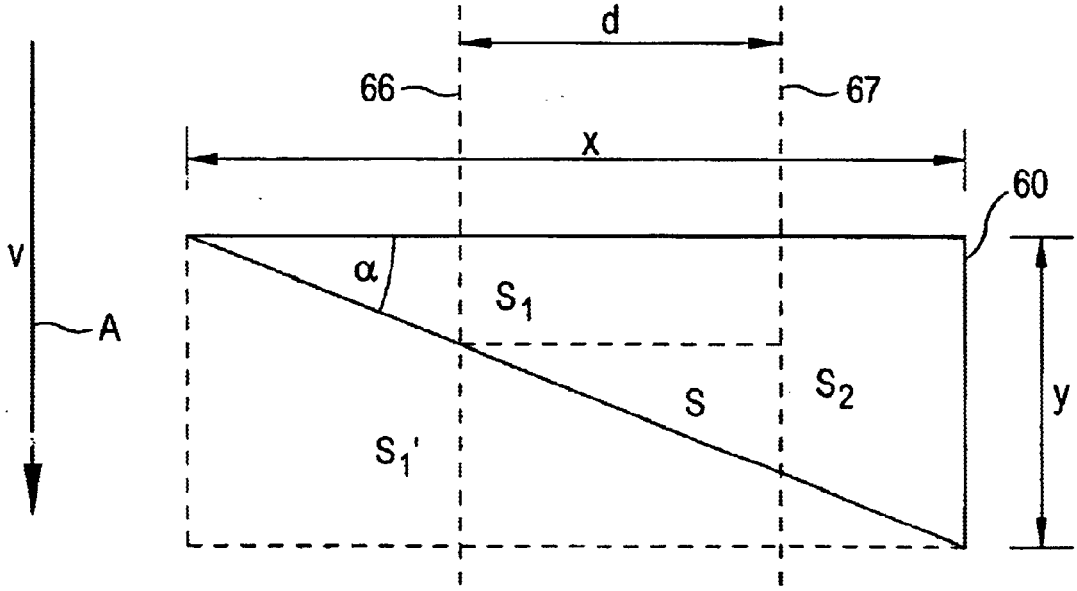

Details of the evaluation are not ascribed on the basis of FIGS. 7*a* and 7*b*, whereby two triangle marks 60 and 60*a* are provided on the band 13 here. As a result thereof, it is possible to determine the current position not only in the transport direction as well as perpendicular thereto but to also determine the current band velocity v.

The two triangle marks 60 and 60*a* are offset relative to one another by the distance Δx perpendicular to the moving direction A. In the moving direction, they are offset by the distance Δy relative to one another. The following is valid given a constant band velocity v:

$$\Delta y = v \cdot \Delta t$$

When the marks 60 and 60*a* or, respectively, the band 13 are sensed along the moving direction on the rated track 64, then the time interval between edges of the two marks 60 and 60*a* corresponding to one another defines the position of the band 13 given a known band velocity. These measurements can ensue with a sensor that is punctiform and whose measured value registration is electronically time-controlled (triggered).

Given the arrangement shown in FIG. 7*a*, the determination of the velocity is then also possible when the band 13 drifts. The track on the band 13 covered by the sensor then follows the track 65. For its deviation $d_1$ from the rated position at the mark 60 and the deviation $d_2$ at the mark 60*a*, the following relationship derives:

$$d_{1,2} = \frac{(s_{1,2} - vt_{1,2})}{\tan\alpha}$$

whereby α represents the slope angle of the sloping edge.

The following then derives for the band velocity v from the geometrical and time intervals of the marks 60 and 60*a* as well as from the lateral offset Δx between the marks 60 and 60*a*, taking a potential band drift $d_1-d_2$ into consideration: The band velocity v follows from the geometrical spacing Δy' and the time interval Δt' of the marks 60 and 60*a* upon involvement of the lateral offset Δx and of a potential band drift $d_1-d_2$:

$$v = \frac{\Delta y'}{\Delta t'} = \frac{\Delta y + \Delta x \tan\alpha - (d_1 - d_2)\tan\alpha)}{\Delta t'}$$

FIG. 7*b* shows a method that is improved compared to the measuring method shown in FIG. 7*a*. The marks 60 and 60*a* are thereby sampled on two tracks 66 and 67 that are situated at a known spacing d. Two relationships thereby mathematically derive between the time lengths and the sampled spacings from which both the band velocity as well as the band position can be determined. With this method, the band position and band velocity can already be determined by the interpretation of a single mark.

When a mark is employed that comprises at least three edges that are not parallel to the moving direction A, and whereof at least two are parallel to one another and these are in turn not parallel to a third edge, then both the band position as well as the band velocity can be determined with a single sensor and a single mark and be employed for regulating these two quantities.

The following relationships for the evaluation of the measured results derive given the procedure illustrated in FIG. 7*b* for the evaluation of a triangle mark 60 on the basis of the two tracks 66 and 67: The following are valid:

| | |
|---|---|
| d = | Spacing of the tracks (known) |
| α = | Aperture angle between the edges (known) |
| v = | Band velocity |
| $s_{1,2}$ = | Edge spacing in the tracks of the detectors |
| $t_{1,2}$ = | Time edge spacing in the tracks of the detectors |

Given a constant velocity v, the following is then valid:

$$s_1 = vt_1 \text{ or, respectively, } s_2 = v_2$$

When, for example, the zero position ($s_2$) of the second track 67 is known, then the following also applies:

$$y/x = s/d$$

or, respectively, $s = dy/x = d \tan \alpha = s_2 - s_1$.

The deviation d from the rated position can thus be calculated:

$$d = (s_2 - vt_1)/\tan \alpha.$$

The two tracks 66 and 67 can be interpreted in the following way:

$$y/x = s/d \rightarrow s = dy/x = d \tan \alpha$$

given a known track spacing d.

$$s_1 + s = s_2 \rightarrow$$

$$t_1 + s/v = t_2 \rightarrow$$

$$v = d \tan \alpha/(t_2 - t_1) \rightarrow$$

$$s_1 = vt_1 = d \tan \alpha t_1/(t_2 - t_1) \text{ or}$$

$$s_2 = vt_2 = d \tan \alpha t_2/(t_2 - t_1).$$

Then following for the deviations of the first track 66 from its rated positions $d_0$ is:

$$d_0 = (s_0 - vt_1)/\tan \alpha = s/\tan \alpha - dt_1/(t_2 - t_1).$$

The deviations $d_0'$ of the second track 76 from its rated position then amounts to $$d_0' = d_0 + d = s_0/\tan \alpha - dt_2/(t_2 - t_1).$$

Instead of acquiring the marks 60 and 60*a* in chronological succession at the same location with a device-rigid sensor, the marks can also be detected at different locations along the moving direction. This, in particular, can ensue isochronically at various locations. For example, CCD area sensors that take a snapshot are suitable for this purpose. The velocity deviation is then determined by the relative topical deviation (vertical line image after time trigger) from a rated position.

For sampling a plurality of tracks, an arrangement having a plurality of light-sensitive diodes (CCD line or diode array) proceeding transversely relative to the moving direction can also be employed instead of a plurality of individual sensors. Moreover, an objective can be employed for the sampling with which the mark is imaged onto the sensors.

When, for example, a CCD line is employed with a high resolution transverse relative to the moving direction, then a plurality of tracks proceeding parallel to one another can be registered corresponding to the number of diodes of the lines. As a result of this fixed arrangement, both the track spacing corresponding to the respective pixel spacing is exactly known, and a high measuring precision on the basis of a high statistical number of measured results by parallel evaluation of the many tracks.

Figure 8:
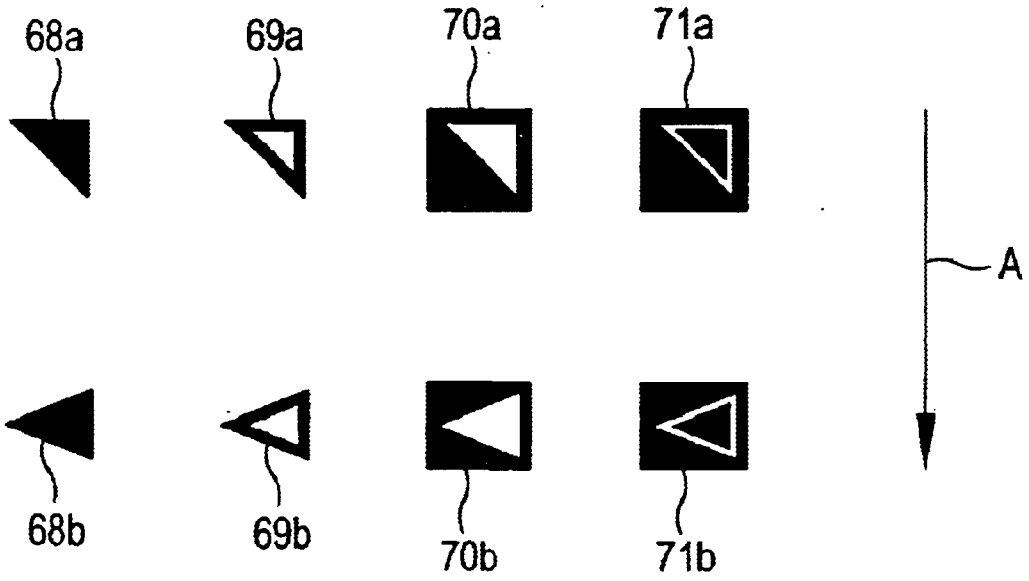
FIG. 8 is a group of various embodiments of triangle marks.

FIG. 8 shows various versions of suitable measurement marks. Whereas the marks 68*a* and 68*b* have two interpretable edges with respect to the moving direction A, the measurement marks 69*a*, 69*b*, 70*a*, 70*b* and 71*a* as well as 71*b* comprise more than two interpretable edges. The marks 71*a* and 71*b*, for example, have six interpretable edges, respectively corresponding to a light/dark transition along the transport direction A. As already mentioned above, the marks can be composed of optical, electrostatic, magnetostatic or mechanical information.

Corresponding mathematical relationships as were already set forth above for the example of the triangle marks on the basis of FIG. 7*b* can be recited for interpreting the measured results at the respective marks.

When the marks are generated in an electrophotographic process by line-by-line writing and subsequent developing, then the timing clock for the lines defines a time interval between the marks on the basis of the outside prescriptions. For every constant velocity, this yields an identical time spacing at the location of a sensor, so that a deviating difference allows conclusions about a changing velocity to be drawn.

By comparing the time spacing of corresponding edges at the location of a sensor to the time difference when writing, a difference value or, respectively, a ratio is defined, as a result whereof a criterion results for the cumulative velocity deviation for the time between the writing of the marks as well as the time between the respective detections of the marks. The deviations between the writing of the second mark and the detection of the first mark are the same for both marks and likewise compensate one another in the evaluation. A farthest-reaching reduction of this time span (time distance between the writing of individual marks) would then approximately correspond to the topical spacing of the detector at a prescribed, average velocity. The measured result is thus more precise. A regulation to a time difference of zero then allows the constancy of a velocity of the band to be adhered to without knowing its exact value. In order to assure the constancy of the original velocity, the sum of all identified time differences must yield zero, i.e. for every time difference there must be on average a corresponding time difference with an opposite operational sign, so that the velocity deviations compensate one another.

Figure 9:
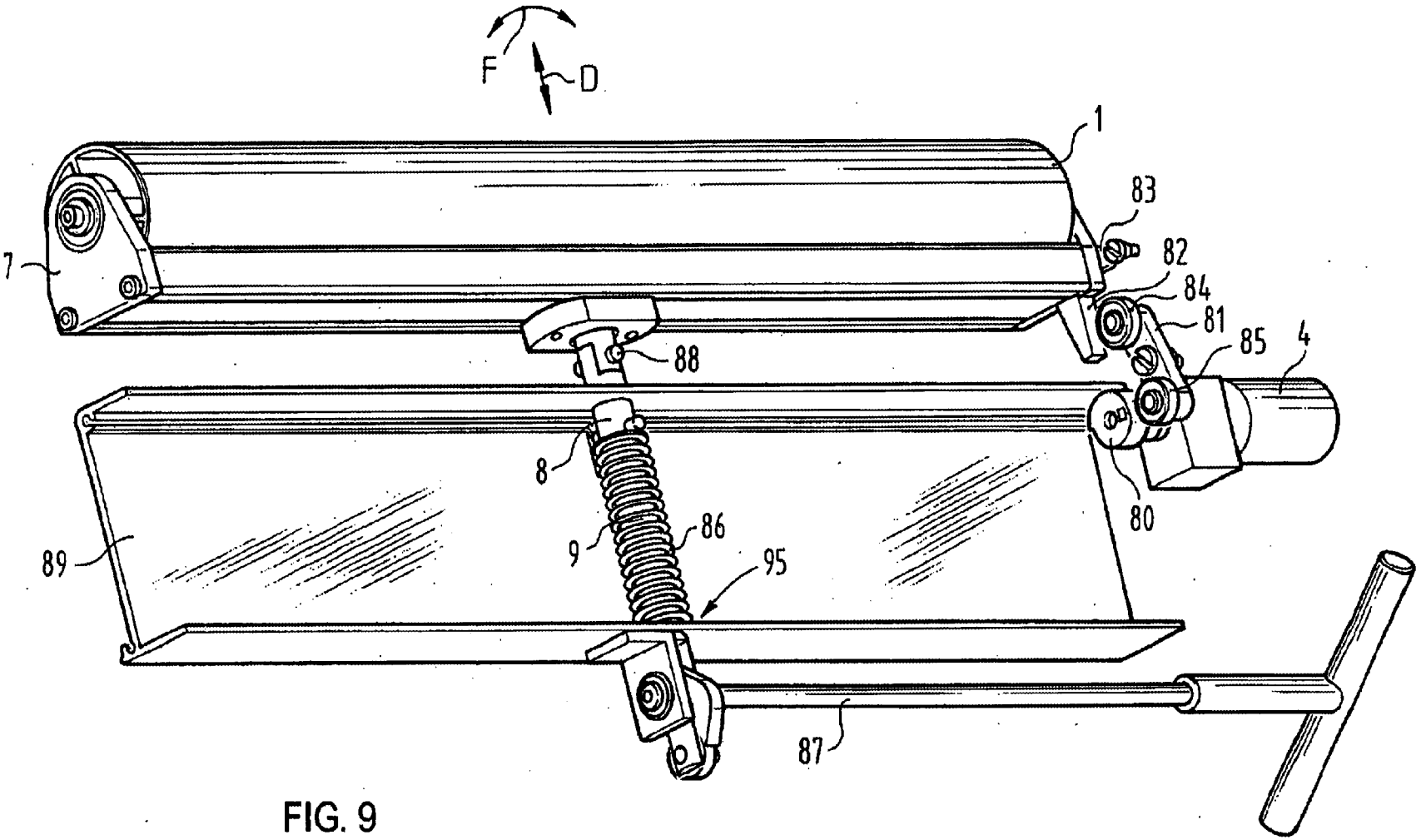
FIG. 9 is a perspective view of a mechanism for regulating a band edge position.
Figure 10:
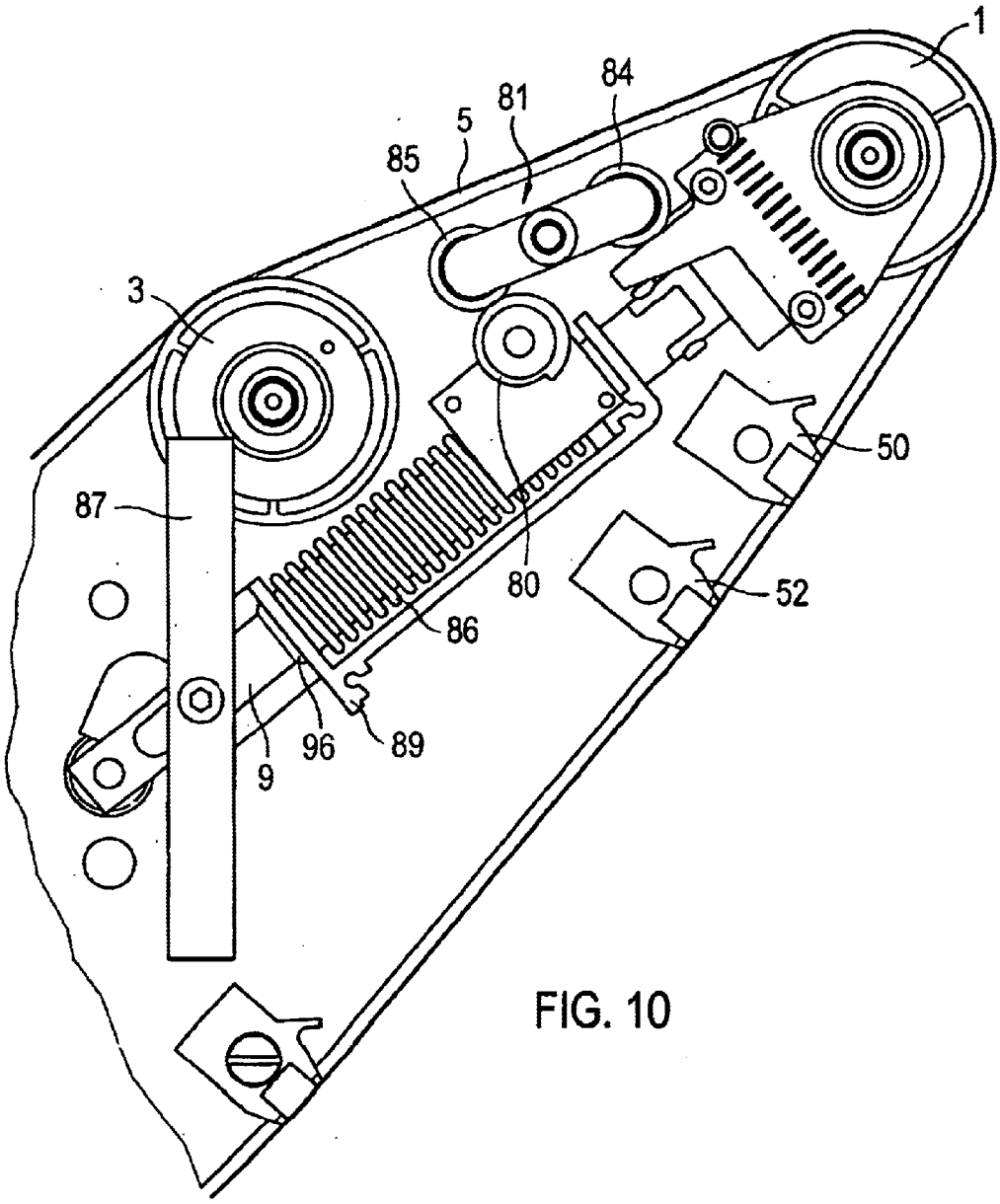
FIG. 10 is a side view of the mechanism of FIG. 9 seen from a different direction.

FIGS. 9 and 10 show an exemplary embodiment related to the third aspect of the invention. Insofar as component parts having similar functions are shown therein, the reference characters of FIGS. 1 and 2 are employed.

The illustrated mechanical tensing and regulating unit is composed of three basic modules, namely of a tensing mechanism for tensing the band with a tension spring 86, the deflection or, respectively, regulating roller 1 as well as a regulating mechanism for tilting the regulating roller 1.

The frame 7 that carries the deflection roller 1 comprises a nose-like projection 82 in this exemplary embodiment via which the tilting motion of the rotating frame 7 and, thus, of the regulating roller 1 around the ball bearing guidance 8 is effected. This nose-like frame bearing 82 interacts for this purpose with a lever arrangement 81 as guide surface. The lever thereby lies play-free via the ball bearing 84 on the frame bearing 82 as well as on a cam 80 via a ball bearing 85, the cam 80 being driven by the motor 4 for tilting the frame 7. The freedom from play between the lever arrangement 81 and the eccentric 80 on the one hand and the frame bearing 82 on the other hand is thereby achieved by a pre-stress that is produced by a spring 83 secured to the housing of the printer device.

The rotating frame 7 has freedom of motion in three directions. The three directions are the direction B along the axis 9 (in the bearing 8), along direction D in the bearing 8 (FIG. 2), as well as along the direction F around the axis 88. The illustrated tensing and regulating mechanism for the band 5 thus meets the following conditions:

B1: The regulating roller 1 has a first degree of freedom (swivel motion in the direction F) that allows its tilting for the compensation of band tolerances.

B2: The regulating roller 1 has a second degree of freedom (linear motion in the direction D) that enables a pull-back of the regulating roller for relaxing the band, for example when the band is replaced.

B3: The regulating roller 1 has a third degree of freedom with which it can execute a play-free and jerk-free swivel motion for regulating the lateral band edge position in the direction E. A swivel motion in the direction E thereby does not deteriorate the two conditions B1 and B2.

Two guide surfaces independent of one another are thus provided for the guidance of the rotating frame 7 or, respectively, of the deflection roller 1 seated therein, namely the surface formed by the frame bearing 82 on the one hand and on which the ball bearing 84 rolls, as well as the bearing 8 wherein the shaft 9 is seated.

The overall rotating frame 7 can be pre-stressed along the direction D with the spring 86, so that a circulating endless band 5 is kept under tension (FIG. 10). For this purpose, the spring 86 lies on a device-rigid base frame 89 in the region 95. The pre-stress can be set with a lever 87 or, respectively, can be completely released therewith in order, for example, to replace the endless band 5.

FIG. 10 shows the arrangement in the installed condition, whereby the lever 87 is engaged in the pre-stress position wherein the band 5 is kept under tension. The band drive is accomplished with the deflection roller 3 that is connected for this purpose to a drive motor (not shown).

For guiding the shaft 9, a guide is provided at both sides of the pre-stress spring 86, namely the linear guide 8 as well as a second linear guide 96 provided in the frame 89. As a result of this both-sided guide design, the guidance of the shaft 9 can ensue with high precision.

In the preceding exemplary embodiments, the adjustment position of the motor 4 or, respectively, of the cam 80 is transferred onto the guide surface 82 via the lever arm 81. In an alternative exemplary embodiment, the lever arm could be foregone and the eccentric motion could be directly transferred from the eccentric 80 onto the rotating frame 7 or, respectively, onto the guide surface 82. Given a linear motion of the roller 1 along the direction D, the eccentric 80 would then glide on the guide surface 82. In such an exemplary embodiment, the two surfaces of the eccentric 80 and of the guide surface 82 are adapted such to one another that only a slight coefficient of friction takes effect between them.

Figure 11:
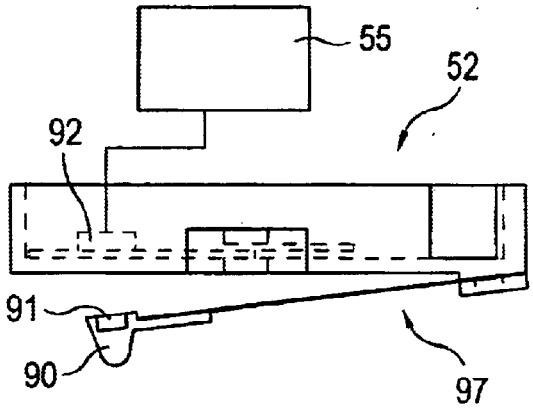
FIG. 11 is a schematic drawing of a band edge sensor.

FIG. 11 shows a mechanical sensor 52 for measuring the lateral band position. A mechanically resistant sensor head 90 coated with a hard ceramic surface is secured to a lever arm 97, the lateral band edge running along the sensor head 90. Other low-wear materials such as hard metal or glass can also be employed for coating or forming the scanner head. A magnet 91 that interacts with a Hall sensor 92 is attached to the backside of the head 90. A shift of the lateral band position thereby causes a lever motion and, thus, a signal in the Hall sensor 92. This signal is output to the microprocessor assembly 55 that regulates the lateral band position.

FIG. 12 again schematically shows a sensor 52 that is analogous to FIG. 11 as well as its function. The band to be sampled, and OPC band 13 here again, carries a punched notch 99 as the mark in the lateral band edge 98. Compared to the mark 52 of FIG. 2 that is not punched into the lateral band edge, this notch-shaped mark 99 yields the advantage that both the acquisition of the mark for determining the band position in transport direction A as well as the acquisition of the lateral position of the band contour can ensue with the same measuring device. Compared to the arrangement according to FIG. 1, one sensor (51) can thus eliminated in the arrangement according to FIG. 12.

Figure 12:
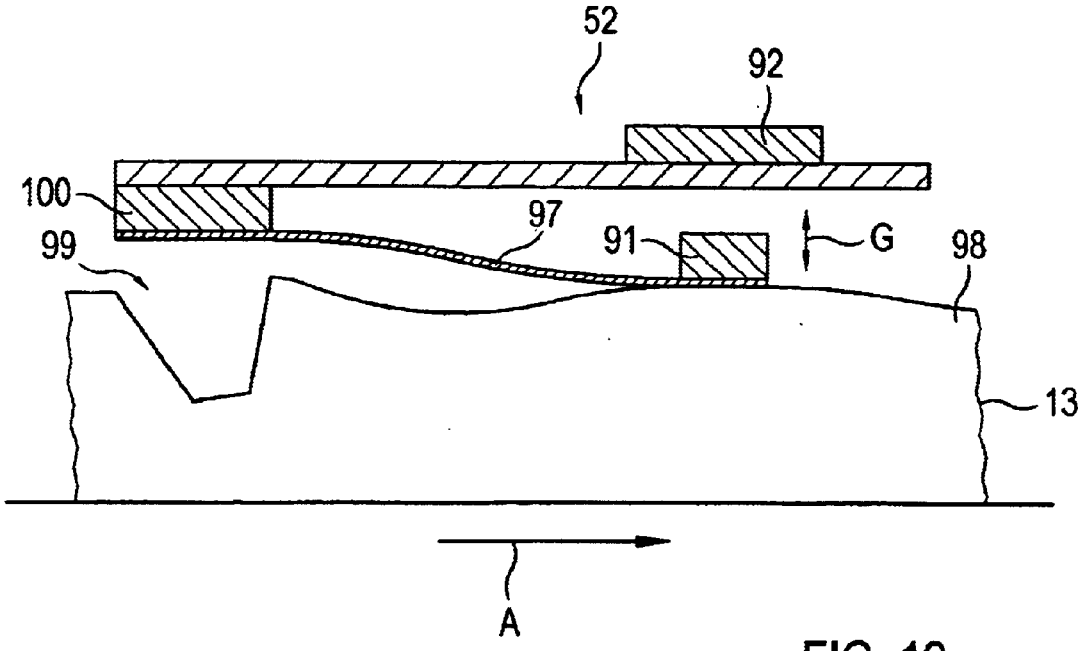
FIG. 12 is a schematic diagram showing a band edge sensor in use.

Given the sensor in FIG. 12, the lever 97 is composed of a leaf spring slightly pre-stressed relative to the band edge 98 and seated in a holder 100, the leaf spring sensing the contour of the band 13 along the direction G or, respectively, tracking its lateral drift motion in the direction G. The permanent magnet 91 is located on the leaf spring 97, this permanent magnet 91 thus following the motion of the band edge. The position of the magnet 91 is acquired via the analog Hall sensor 92 and the output signal thereof is employed as an input quantity for the regulation. When a Hall sensor with an integrated amplifier is utilized, then additional electronics can be foregone.

Figure 13:
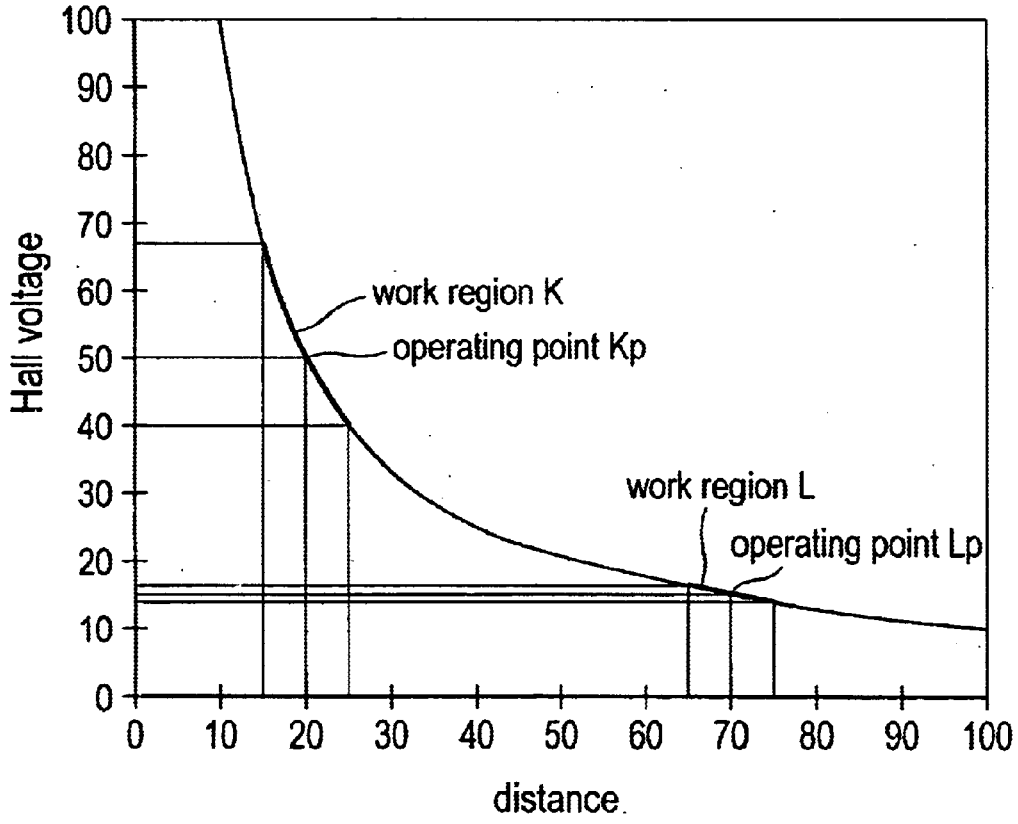
FIG. 13 is a graph of the characteristic of a band edge sensor.

Since the magnet 91 is brought up to the Hall sensor 92 in the axial direction, a characteristic of the sensor derives dependent on the distance between sensor 92 and magnet 91, this qualitatively corresponding to the 1/x function. This characteristic is shown in FIG. 13. Accordingly, the sensor 52 becomes all the more sensitive the smaller the distance is between Hall sensor 92 and magnet 91. As a result thereof, the sensitivity of the sensor 52 can be varied by means of the position of the operating point of the regulation. The sensitivity in the operating point $K_p$ is thus higher than in the operating point $L_p$. In the closer environment of the operating points, i.e. in the respective working range K or, respectively, L, the characteristic can be considered to be linear. When this property is not desired, a linear characteristic can be achieved with a large magnet that is moved in a lateral direction or with two magnets.

The stiffness of the spring 97 is adapted to the mass of the spring and of the magnet and to the stiffness of the band edge such that vibrations are largely avoided. Remaining natural vibrations of the spring caused by the excursion of the band edge can be largely reduced by a low-pass filtering of the measured signal or by mechanical damper elements.

It can be provided for sampling the lateral position of thin, flexible bands that be guided in the region of the sensor. As a result, the tendency of the band to buckle is suppressed. Such a guidance can, in particular, be achieved in that the sensor is attached in a region wherein the band already exhibits a greater stability. This, for example, is the case in the region of drive or deflection rollers since the band is stabilized here by the curvature around the roller. For this purpose, it is particularly provided that the band projects laterally beyond the roller edge in the sensor region.

Instead of the magnet and the Hall sensor in the mechanical edge sensor, a capacitative or inductive approach or angle sensor could also be utilized for the acquisition of the lever position and, thus, of the lateral band position.

Although the invention was described with a web-shaped recording medium, it can be just as easily employed for printer or copier devices that comprise band-shaped intermediate image carriers that ultimately print the information onto single sheets. Instead of the described, opto-electronic sensors, sensors can also be used that are based on different physical effects, for example capacitative or inductive sensors, as long as the corresponding features (marks) to be detected are adapted to be detectable in a corresponding way. For example, the marks can be recessed and produce a different capacitance in the sensor than the material of a band surrounding the mark.

The inventive electronic procedures can be realized with software or hardware in a computer-controlled system, particularly in the form of a computer program element.

The terms photoconductor band and transfer band are interchangeable with one another in view of many aspects of the present invention. The invention is suited not only for regulating the lateral position of a photoconductor band or transfer band but can also be fundamentally utilized for any band-shaped intermediate image carrier. For example, the lateral position of a band suitable for magnetography or of a transfer band as described in FIG. 1 can also be regulated therewith. The image generation of the transfer band thereby occurs at the connecting location to the photoconductor band, and the image output to the recording medium (paper) ensues in the transfer printing region.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for regulating a lateral position of a band-shaped intermediate image carrier in an electrographic device that is moved along a transport direction from an image-generating position at which an image is generated on the intermediate image carrier to a transfer printing position at which the intermediate image carrier outputs information corresponding to the image, comprising the steps of:

acquiring a mark on the intermediate image carrier regularly with a device-fixed sensor;

acquiring a position of the intermediate image carrier transversely relative to the transport direction time-correlated with said step of acquiring the mark;

implementing intermediate measurements of the position of the intermediate image carrier time-controlled between the regular acquisitions of the mark;

comparing the acquired position values of the intermediate image carrier respectively to stored or calculated rated position values; and utilizing the comparison values for driving a position correction apparatus with which the position of intermediate image carrier can be changed transversely relative to the transport direction;

wherein a plurality of position values of a lateral band edge are registered for determining the rated position values in a measurement event over a complete band revolution, wherein the first position is acquired a first time at the beginning of the band revolution and a second time at the end of the band revolution, the difference between the two position values of the first position is formed and correction values are formed therefrom for determining the actual course of the band edge, and wherein the correction values for the remaining positions of the band edge are determined by linear regression from the difference between the two measured values of the first position and from the spacings of the positions in band transport direction.

2. A method according to claim 1, wherein the intermediate image carrier is an endless band, and said step of acquiring the mark acquires the mark only once per revolution of the endless band.

3. A method according to one of the claim 1, further comprising the step of:

generating clock signals for the time-control of the intermediate measurements.

4. A method according to claim 3, further comprising the step of:

selecting the clock frequency of the clock signals from a plurality of frequencies.

5. A method according to claim 1, wherein the mark is a first edge that proceeds essentially perpendicularly to the transport direction of the intermediate image carrier and a second edge that proceeds inclined relative to the first edge.

6. A method according to claim 1, further comprising the step of:

transporting the intermediate image carrier with constant velocity.

7. A method according to claim 1, wherein the intermediate image carrier is a photoconductor.

8. A method according to claim 1, whereby the position correction apparatus includes a tiltable roller that serves as a deflection roller for the intermediate image carrier.

9. A method according to claim 8, further comprising the step of:

driving a motor that effects a tilting of the roller depending on the comparison values.

10. An apparatus for regulating a lateral position of a band-shaped intermediate image carrier in an electrographic device, comprising:

a band-shaped intermediate image carrier in the electrographic device movable in a transport direction;

an image generating position of said electrographic device which generates an image on said band-shaped intermediate carrier;

a transfer printing position of said electrographic device which outputs information corresponding to the image;

a fixed sensor mounted in said electrographic device at a position to sense a mark on said band-shaped intermediate carrier, said fixed sensor sensing said mark at regular intervals;

a transverse sensor positioned to acquire position values of said band-shaped intermediate carrier in a direction transverse to the transport direction at times correlated to sensing of the mark, said sensor obtaining intermediate measurements at times between the sensing of the mark;

a control connected to said fixed sensor and said transverse sensor, said control having access to rated position values and comparing position values of said band-shaped intermediate carrier to the rated values to provide comparison values;

a position corrector connected to said control to receive said comparison values with which a position of said band-shaped intermediate image carrier is changed transversely of the transport direction;

said transverse sensor registers a plurality of positions values of a lateral edge of said band-shaped intermediate image carrier as a measuring event over a complete revolution of said band-shaped intermediate image carrier, a first of said positions being registered a first time at a beginning of said complete revolution and a second time at an end of said complete revolution, said control determining a difference between said positions of said first time and said second time and forming correction values for determining an actual course of said lateral edge, said control determining correction values for remaining positions of the band edge by linear regression from said difference between said positions of said first time and said second time and from spacings of said positions in the transport direction;

a deflection roller in a frame over which the band-shaped intermediate image carrier is guided, the deflection roller being linearly movable in a direction substantially parallel to the transport direction, said deflection roller being swivellable in a direction around an axis parallel to the transport direction;

said position corrector including a first guide connected to said position control and operable to move said deflection roller linearly; and said position corrector including a second guide connected to said position control and operable to swivel said deflection roller.

11. An apparatus according to claim 10, wherein said second guide includes a guide surface firmly connected to said frame and on which a bearing element rolls play-free.

12. An apparatus according to claim 11, wherein said frame is pre-stressed against a rocker with a spring.

13. An apparatus according to claim 10, wherein said transverse sensor is a mechanical sensor having a lever provided with a permanent magnet, said lever lies against the band edge of said band-shaped intermediate image carrier under pres-stress and a position of the lever is determined by measured signals thereof are generated by a Hall sensor.

14. An apparatus according to claim 10, wherein said mark is a notch punched into a lateral band edge of said band-shaped intermediate image carrier.

15. An electrographic printer or copier device, comprising:

a band-shaped intermediate image carrier in the electrographic device movable in a transport direction;

an image generating position of said electrographic device which generates an image on said band-shaped intermediate carrier;

a transfer printing position of said electrographic device which outputs information corresponding to the image;

a fixed sensor mounted in said electrographic device at a position to sense a mark on said band-shaped intermediate carrier, said fixed sensor sensing said mark at regular intervals;

a transverse sensor positioned to acquire position values of said band-shaped intermediate carrier in a direction transverse to the transport direction at times correlated to sensing of the mark, said transverse sensor obtaining intermediate measurements at times between the sensing of the mark;

a control connected to said fixed sensor and said transverse sensor, said control having access to rated position values and comparing position values of said band-shaped intermediate carrier to the rated values to provide comparison values;

a position corrector connected to said control to receive said comparison values with which a position of said band-shaped intermediate image carrier is changed transversely of the transport direction;

said transverse sensor registers a plurality of positions values of a lateral edge of said band-shaped intermediate image carrier as a measuring event over a complete revolution of said band-shaped intermediate image carrier, a first of said positions being registered a first time at a beginning of said complete revolution and a second time at an end of said complete revolution, said control determining a difference between said positions of said first time and said second time and forming correction values for determining an actual course of said lateral edge, said control determining correction values for remaining positions of the band edge by linear regression from said difference between said positions of said first time and said second time and from spacings of said positions in the transport direction;

a deflection roller in a frame over which the band-shaped intermediate image carrier is guided, the deflection roller being linearly movable in a direction substantially parallel to the transport direction, said deflection roller being swivellable in a direction around an axis parallel to the transport direction;

said position corrector including a first guide connected to said position control and operable to move said deflection roller linearly; and said position corrector including a second guide connected to said position control and operable to swivel said deflection roller.

16. A system for regulating a lateral position of a band-shaped intermediate image carrier in an electrographic device that is moved along a transport direction from an image-generating position at which the image is generated on said carrier to a transfer printing position at which said band-shaped intermediate image carrier outputs information corresponding to the image, comprising:

a device-fixed sensor with which a mark on the intermediate image carrier is regularly acquired;

a transverse sensor operable to acquire a position of said band-shaped intermediate image carrier transversely relative to the transport direction time-correlated with acquisition of the mark, said transverse sensor implementing intermediate measurements of a position of said band-shaped intermediate image carrier time-controlled between the regular acquisitions of the mark;

a control by which acquired position values of said band-shaped intermediate image carrier are respectively compared to stored or calculated rated position values to provide comparison values;

a position corrector receiving the comparison values with which the position of intermediate image carrier is changed transversely relative to the transport direction, said transverse sensor registering a plurality of position values of a lateral band edge for determining a rated position values in a measurement event over a complete band revolution of said band-shaped intermediate image carrier, a first position being acquired a first time at a beginning of the band revolution and a second time at an end of the band revolution, said control forming a difference between the two position values of the first position and forming correction values therefrom for determining an actual course of the band edge, and said control determining correction values for remaining positions of the band edge by linear regression from a difference between the two measured values of the first position and from spacings of positions in the transport direction.

* * * * *